United States Patent [19]

Asakura

[11] Patent Number: 4,708,504

[45] Date of Patent: Nov. 24, 1987

[54] PINCH ROLLER ASSEMBLY FOR SHEET FEEDING

[75] Inventor: Osamu Asakura, Tokyo, Japan

[73] Assignee: Canon Kabushiki Kaisha, Tokyo, Japan

[21] Appl. No.: 881,282

[22] Filed: Jul. 2, 1986

[30] Foreign Application Priority Data

Jul. 10, 1985 [JP] Japan ..... 60-151875

[51] Int. Cl.[4] ..... B41J 13/054

[52] U.S. Cl. ..... 400/637; 400/636.3

[58] Field of Search ..... 400/636, 637, 636.3, 400/637.3, 637.5

[56] References Cited

U.S. PATENT DOCUMENTS

| | | | |
|---|---|---|---|
| 624,135 | 5/1899 | Wagner | 400/637.3 X |
| 1,108,805 | 8/1914 | Stickney | 400/637.5 X |
| 1,841,116 | 1/1932 | Garbell | 400/636.3 |
| 2,501,117 | 3/1950 | Yaeger | 400/637.5 |

FOREIGN PATENT DOCUMENTS

| | | | |
|---|---|---|---|
| 917243 | 12/1946 | France | 400/637 |
| 292367 | 6/1928 | United Kingdom | 400/637.5 |

*Primary Examiner*—Edgar S. Burr
*Assistant Examiner*—Joseph McCarthy
*Attorney, Agent, or Firm*—Fitzpatrick, Cella, Harper & Scinto

[57] ABSTRACT

The present invention provides a paper feeder used in recording systems including printers and comprising feed and pinch rollers between which there is produced a nip used to hold and convey a sheet of paper therebetween. The pinch roller can be engaged or disengaged by the feed roller in a simple and precise manner.

14 Claims, 5 Drawing Figures

PINCH ROLLER ASSEMBLY FOR SHEET FEEDING

BACKGROUND OF THE INVENTION

1. Field of the Invention

The present invention relates to a recording apparatus such as a printer and more particularly a paper feeder suitable for use in such a recording apparatus, said paper feeder including feed and pinch rollers between which there is formed a nip for holding and conveying a sheet of paper.

2. Related Background Art

In recording systems such as printers, facsimile devices copiers and typewriters, there are currently used a paper feeder comprising feed roller means for transmitting a feed force to a sheet of recording paper and pinch roller means biased against the feed roller means under the action of spring means to press the sheet of recording paper against the feed roller means.

The pinch roller means may include a single pinch roller located at a position on the periphery of the feed roller means in the direction of paper feed. However, the most general pinch roller means includes a plurality of pinch rollers arranged along the periphery of the feed roller means and spaced apart from one another.

In the conventional paper feeders of such a type, two arms are pivotally mounted on the recording machine body and connected at their distal ends with each other by means of a shaft which extends parallel to the rotating shaft of the feed roller. The shaft connecting the two arms rotatably supports a pinch roller. When the arms are pivotally moved, the pinch roller can be engaged with the feed roller under pressure or separated from the feed roller.

Such an arrangement is disadvantageous in that the mechanism thereof becomes complicated and requires a relatively large space for installation. In addition, the pinch roller means must be remotely controlled through a linkage or the like so that its operational precision will be reduced.

SUMMARY OF THE INVENTION

In order to overcome the disadvantages of the prior art paper feeders, the present invention provides a paper feeder comprising feed roller means for transmitting a feeding force to a sheet of paper, drive means for driving said feed roller means, rotary body means disposed opposed to said feed roller means such that said rotary body means can be engaged with or separated from said feed roller means, said rotary body means being adapted to co-operate with said feed roller means for holding and conveying the sheet of paper therebetween, means for biasing said rotary body means against said feed roller means, and separating means including ramp means reciprocatable between an operative position wherein said rotary body means is separated from said feed roller means by said ramp means against the action of said biasing means and an inoperative position wherein said ramp means permits said rotary body means to engage said feed roller means.

DESCRIPTION OF PREFERRED EMBODIMENTS

Figure 1:
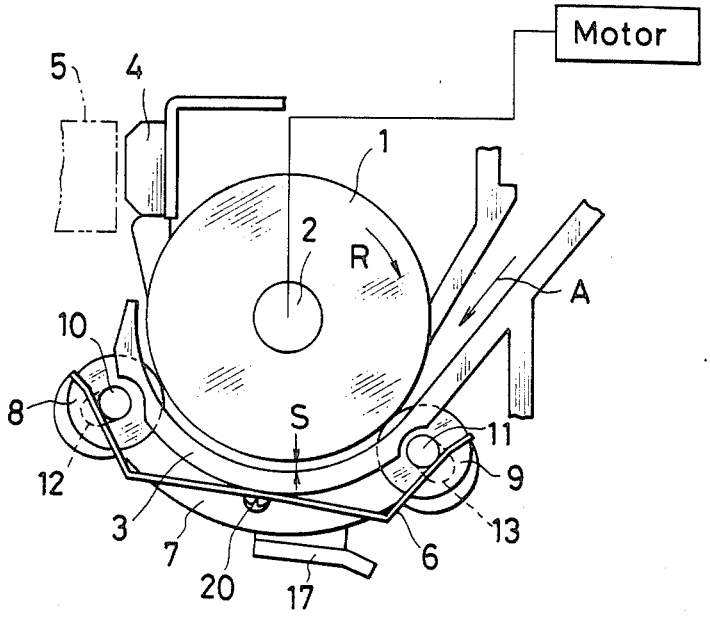
FIG. 1 is a cross-sectional view of a first embodiment of the present invention, passing through the central portion of a feed roller, with a pinch roller being shown to engage the feed roller under pressure.

Referring to FIG. 1, there is shown a feed roller 1 for transmitting a feeding force to a sheet of paper. The feed roller 1 is mounted on a shaft 2 in a recording machine body (not shown) such that the feed roller 1 can be rotatably driven in the direction of arrow R by means of a motor. A paper guide 3 is located around the outer periphery of the feed roller to form a predetermined gap S therebetween.

A sheet of paper is supplied into the machine in the direction of arrow A and then guided along a feed passage or gap between the outer periphery of the feed roller 1 and the inner wall of the paper guide 3. At a position forwardly and upwardly of the feed roller 1, the sheet of paper is inserted between a platen 4 and a recording head 5 and thereafter discharged upwardly therefrom.

On the outer wall of the paper guide 3 are rigidly mounted a biasing spring 6 and a pinch roller cover 7 by means of a machine screw 20.

Figure 4:
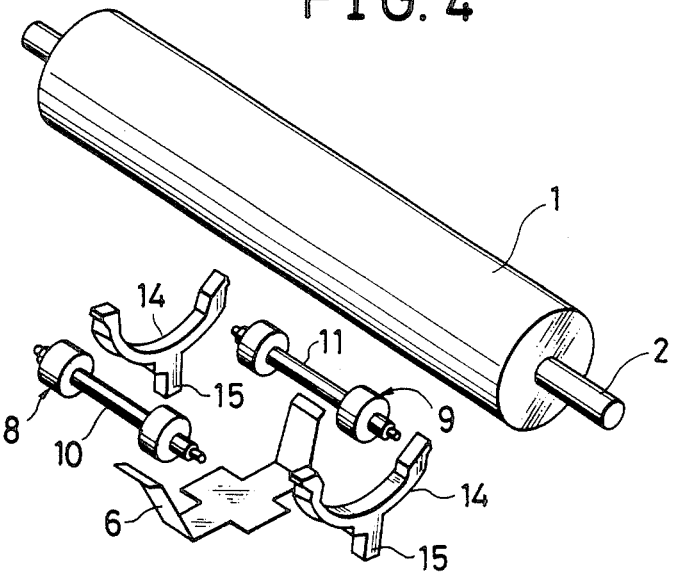
FIG. 4 is an exploded and perspective view of the first embodiment of the present invention, showing major components used therein.

Two pinch rollers 8 and 9 having such a construction as shown in FIG. 4 are located along the circumference of the feed roller 1 at two positions spaced apart from each other such that the pinch rollers 8 and 9 can be engaged or disengaged by the feed roller 1 in a manner as will be described hereinafter.

Each of the pinch rollers 8 and 9 includes an axle 10 or 11 the opposite ends of which are respectively fitted into slots 12 and 13 formed in the pinch roller cover 7 on the opposite sides. The central portion of each of the axles 10 and 11 is engaged by one end of the biasing spring 6 such that the respective one of the pinch rollers 8 and 9 will be biased toward the feed roller 1 under the action of the biasing spring 6.

Figure 2:
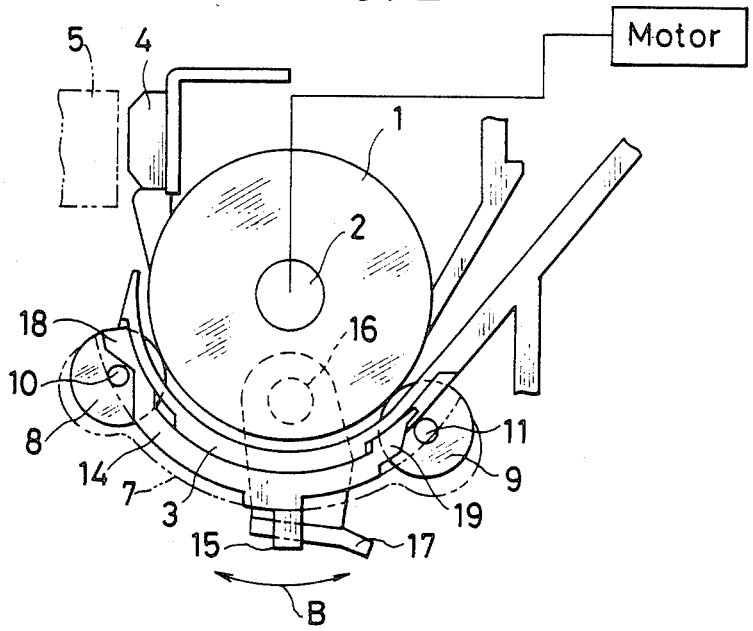
FIG. 2 is a cross-sectional view of the first embodiment in the same condition as shown in FIG. 1, passing through the end portion of the feed roller.
Figure 3:
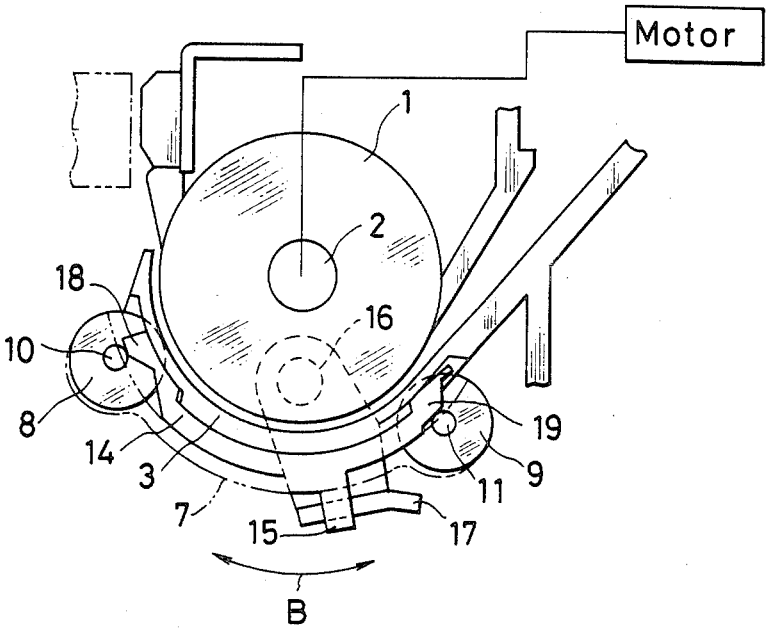
FIG. 3 is a cross-sectional view of a second embodiment of the present invention, passing through the end of a feed roller, with a pinch roller being shown to disengage the feed roller.

As shown in FIGS. 2 and 3, separating means 14 is mounted on the outer face of the paper guide 3 in such a manner that the separating means 14 is slidable in a direction perpendicular to the shaft of the feed roller 1. In the illustrated embodiment, the separating means includes two separating members 14 each of which is of a substantially Y-shaped configuration as shown in Figure 4. The arm portions of each of the separating members 14 engage the respective end portions of the axles 10 and 11 of the pinch rollers 8 and 9.

In the illustrated embodiment, each of the separating members 14 is slidably mounted between the outer wall of the paper guide 3 and the respective one of arcuate grooves which are formed in the pinch roller cover 7 on the opposite sides thereof.

Each of the separating members 14 has a downwardly extending leg 15 engaging a release lever 17 which extends along the longitudinal extent of the feed roller 1 and which is pivotally mounted on the recording machine body through a shaft 16. When this release lever 17 is moved in the direction of arrow B as by an actuating lever (not shown), the separating members 14 also are moved in the same direction.

Each of the separating members 14 has its opposite ends formed with cams or ramps 18 and 19, respectively.

In the position of FIG. 2, the pinch roller axles 10 and 11 are not subjected to any shift. Thus, the pinch rollers 8 and 9 are in their positions wherein they are engaged by the feed roller (through a sheet of paper if it is inserted therebetween) under the action of the biasing spring 6. In the position of FIG. 3, the cams 18 and 19 of each of the separating members 14 are inserted between the pinch roller axle 10 or 11 and the outer wall of the paper guide 3. As a result, the corresponding pinch roller 8 or 9 is held at a position spaced apart from the feed roller 1 (release position) against the action of the biasing spring 6.

Such engagement or disengagement of the pinch rollers 8 and 9 with the feed roller 1 is accomplished by reciprocating the release lever 17 in the direction of arrow B when the actuating lever (not shown) is operated. The disengagement of the pinch rollers 8 and 9 from the feed roller 1 to release a paper feed is carried out, for example, when it is desired to insert a sheet of paper into the recording machine, to remove a recorded sheet from the recording machine or to correct any obstruction such as skewing or jamming.

Figure 5:
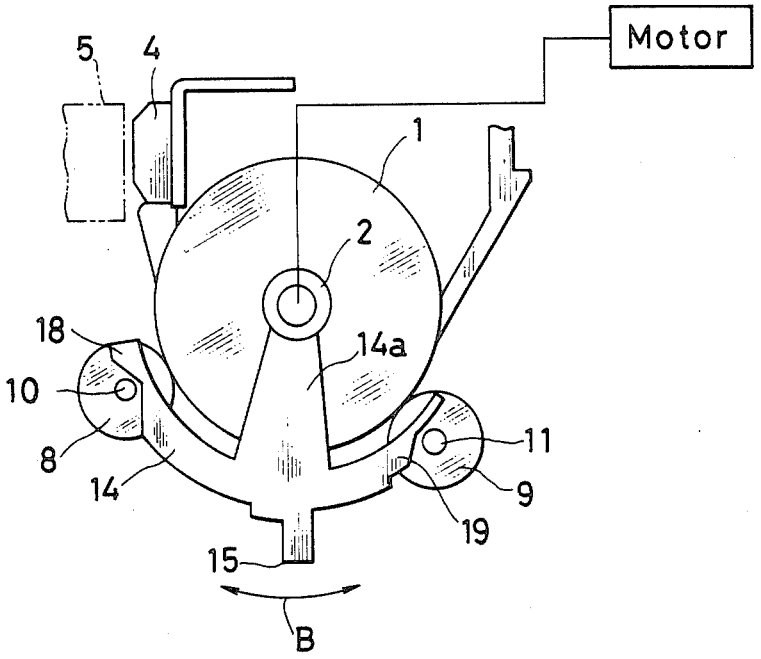
FIG. 5 is a view similar to FIG. 3, showing the pinch roller engaged by the feed roller under pressure.

Referring now to FIG. 5, there is shown a second embodiment of the present invention wherein each of the separating members 14 includes an arm 14*a* which is pivotally mounted on the shaft 2 of the feed roller 1. When such separating members 14 are pivoted about the shaft 2 in the direction of arrow B, the pinch rollers 8 and 9 can be engaged or disengaged by the feed roller 1.

Mostly, two to four pinch rollers are disposed along the longitudinal extent of the feed roller 1 on one side at locations spaced apart from one another.

Since in the illustrated embodiments, the separating means 14 is slidable movable along the outer wall of the paper guide 3 or pivotable about the shaft 2 of the feed roller 1 such that the pinch rollers 8 and 9 can be engaged or disengaged by the feed roller, the paper feeder can be constructed simply and compactly. Furthermore, the pinch rollers can accurately be separated or released from the feed roller.

Even if a plurality of pinch rollers are arranged along the outer periphery of the feed roller 1 at locations spaced apart from one another (in the illustrated embodiments, two pinch rollers at such locations), these pinch rollers can simultaneously be separated from the feed roller in a stable manner by actuating a single separating means.

As can be seen from the first embodiment, moreover, the pinch rollers 8 and 9 can be separated from the feed roller while acting an outwardly directed force on the paper guide 3 through the biasing spring 6 and at the same time acting an inwardly directed reaction from the separating means 14 on the paper guide 3. Such two opposite forces can be offset at the paper guide 3. Thus, the paper guide 3 can be formed with high reliability in strength and positional precision.

The present invention can equally be applied to printers of various types such as thermal type, wire-dot type, ink-jet type and any other types.

I claim:

1. A sheet feeding apparatus comprising:

a feed roller for feeding a sheet of paper;

drive means for driving said feed roller;

a sheet guide disposed about a substantial portion of the periphery of said feed roller;

opposed rotating members mounted so as to be able to be pressed against and separated from said feed roller, wherein said rotating members cooperate with said feed roller to convey the sheet of paper when said rotating members are pressed against said feed roller with the sheet of paper therebetween;

biasing means for biasing said rotating members; against said feed roller; and separating means extending about a substantial portion of said sheet guide and movable between an operative position, wherein said rotating members are separated from said feed roller against said biasing means, and an inoperative position, wherein said rotating members are pressed against said feed roller by said biasing means, said separating means being movable about and guided by said sheet guide for movement between the operative and inoperative positions.

2. A sheet feeding apparatus according to claim 1, wherein said rotating members include a plurality of rotary bodies along the circumference of said feed roller.

3. A sheet feeding apparatus according to claim 1, wherein said rotating members comprise pinch roller means.

4. A sheet feeding apparatus according to claim 1, wherein said biasing means is a leaf spring.

5. A sheet feeding apparatus according to claim 1, wherein said separating means slides reciprocatingly on said sheet guide.

6. A sheet feeding apparatus according to claim 1, wherein said biasing means is disposed on said sheet guide.

7. A sheet feeding apparatus according to claim 1, wherein said separating means includes a ramp surface for moving said rotating members.

8. A sheet feeding apparatus according to claim 2, wherein said ramp surface of said separating means is adapted to lift a rotating shaft supporting said rotating members so as to cause said separating means to take the operative position.

9. A sheet feeding apparatus comprising:

a feed roller for feeding a sheet of paper;

drive means for driving said feed roller;

opposed rotating members mounted so as to be able to be pressed against and separated from said feed roller, wherein said rotating members cooperate with said feed roller to convey the sheet of paper when said rotating members are pressed against said feed roller with the sheet of paper therebetween;

biasing means for biasing said rotating members against said feed roller;

separating means movable about said feed roller and including ramp surfaces; and means for cooperating with said ramp surfaces;

whereby said rotating members are separated from said feed roller by said ramp surfaces against said biasing means upon movement of said separating means in one direction and said rotating members are pressed against said feed roller by said biasing means upon movement of said separating means in a second direction.

10. A sheet feeding apparatus according to claim 9, wherein said rotating members include a plurality of rotary bodies along the circumference of said feed roller means.

11. A sheet feeding apparatus according to claim 9, wherein said rotating members comprise pinch rollers.

12. A sheet feeding apparatus according to claim 9, wherein said biasing means is a leaf spring.

13. A sheet feeding apparatus as defined in claim 9, wherein said rotating members include a plurality of rotary bodies along the outer peripheral face of said feed roller.

14. A sheet feeding apparatus according to claim 9, wherein said ramp surfaces of said separating means are adapted to lift a rotating shaft supporting said rotating members.

* * * * *

UNITED STATES PATENT AND TRADEMARK OFFICE

CERTIFICATE OF CORRECTION

PATENT NO. : 4,708,504

DATED : November 24, 1987

INVENTOR(S) : OSAMU ASAKURA

It is certified that error appears in the above-identified patent and that said Letters Patent is hereby corrected as shown below:

COLUMN 1

Line 15, "vices copiers" should read --vices, copiers--.
Line 37, "thereof" should read --therefor--.

COLUMN 3

Line 41, "slidable" should read --slidably--.

COLUMN 4

Line 12, "members;" should read --members--.
Line 42, "claim 2," should read --claim 7,--.

Signed and Sealed this

Third Day of May, 1988

*Attest:*

*Attesting Officer*

DONALD J. QUIGG

*Commissioner of Patents and Trademarks*